United States Patent [19]

Coccia

[11] 4,238,225

[45] Dec. 9, 1980

[54] METHOD OF MONITORING CONVERSION OF IRON ORE INTO HIGH CONTENT PELLETS

[75] Inventor: Larry A. Coccia, Elizabeth, Pa.

[73] Assignee: Pullman Incorporated, Chicago, Ill.

[21] Appl. No.: 35,867

[22] Filed: May 3, 1979

[51] Int. Cl.[3] ..... C21B 13/02

[52] U.S. Cl. ..... 75/33; 75/34; 266/90

[58] Field of Search ..... 266/90; 75/26, 33, 34, 75/35

[56] References Cited

U.S. PATENT DOCUMENTS 2,760,769 8/1956 Onstad ..... 266/78

*Primary Examiner*—M. J. Andrews

*Attorney, Agent, or Firm*—Richard J. Myers

[57] ABSTRACT

Apparatus and method for monitoring selected samples in situ in an iron ore converter the stages of reduction of the ore into iron sponge pellets having a desired iron content. The apparatus comprises a series of induction coils encircling the converter. The coils are coupled to an R F Circuit which is coupled to a meter which indicates the inductance values correlated with the iron content of the measured sample and its temperature thus providing indicia of the stage of conversion of the ore.

20 Claims, 12 Drawing Figures

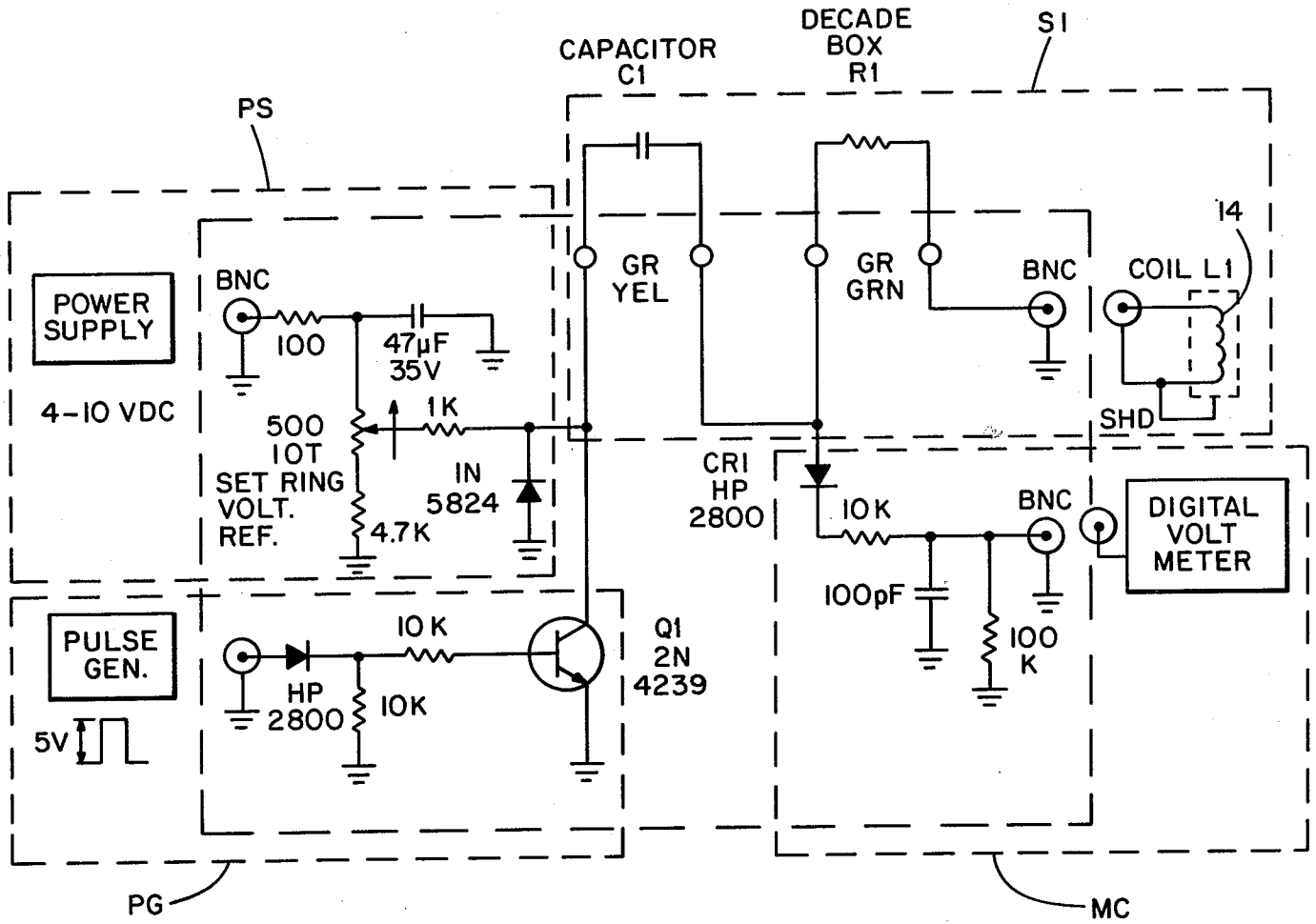
FIG. 6 CIRCUIT DIAGRAM OF EFFECTIVE SERIES RESISTANCE MEASURING EQUIPMENT

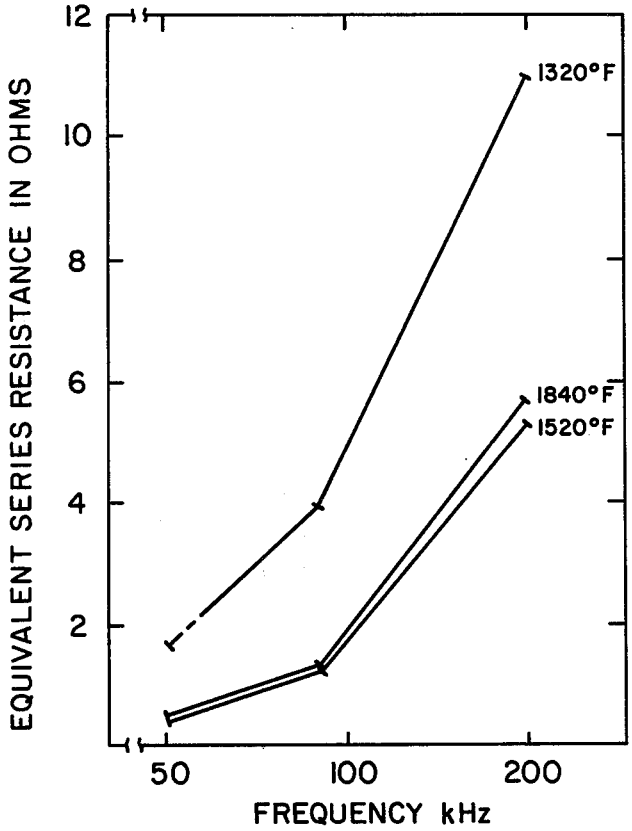
FIG. 7 MEASURED COIL RESISTANCE VERSUS FREQUENCY FOR REDUCED PELLETS
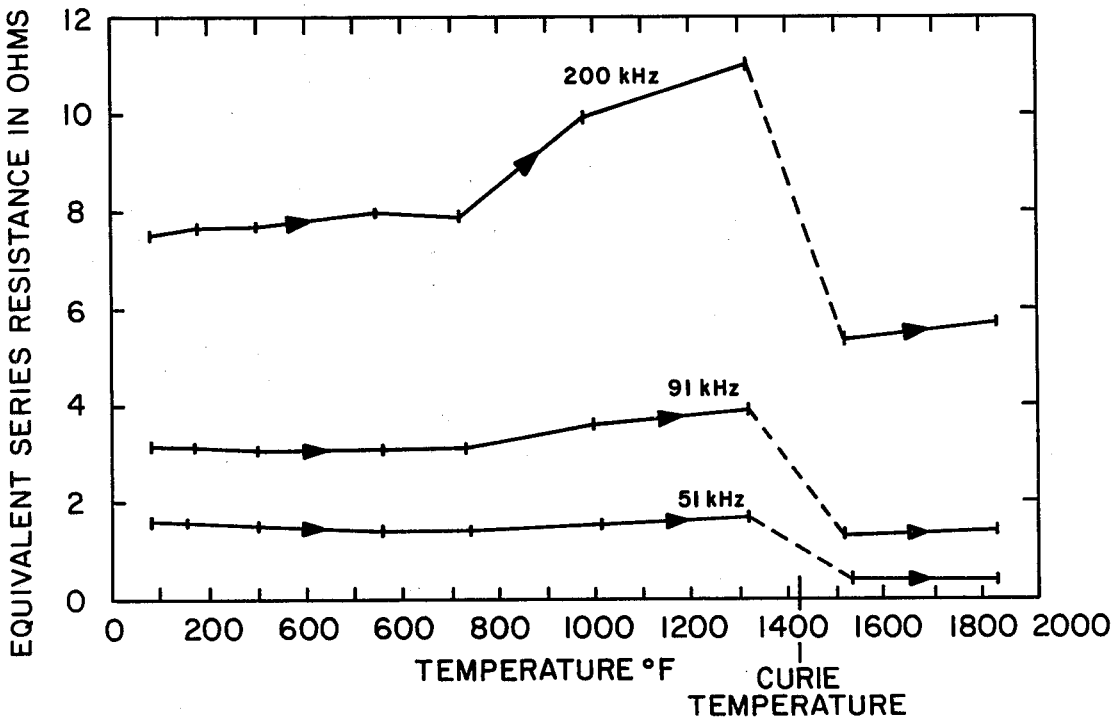
FIG. 8 MEASURED COIL RESISTANCE VERSUS TEMPERATURE REDUCED PELLETS – RUN 1

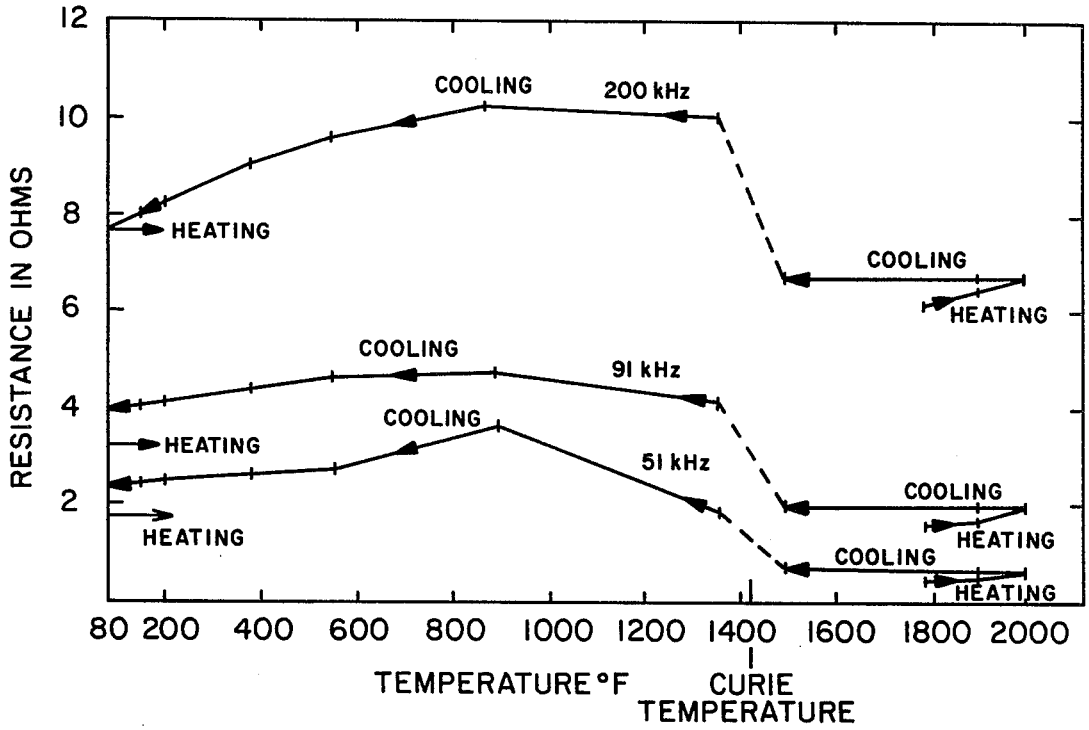
FIG. 9 MEASURED COIL RESISTANCE VERSUS TEMPERATURE REDUCED PELLETS - RUN 2
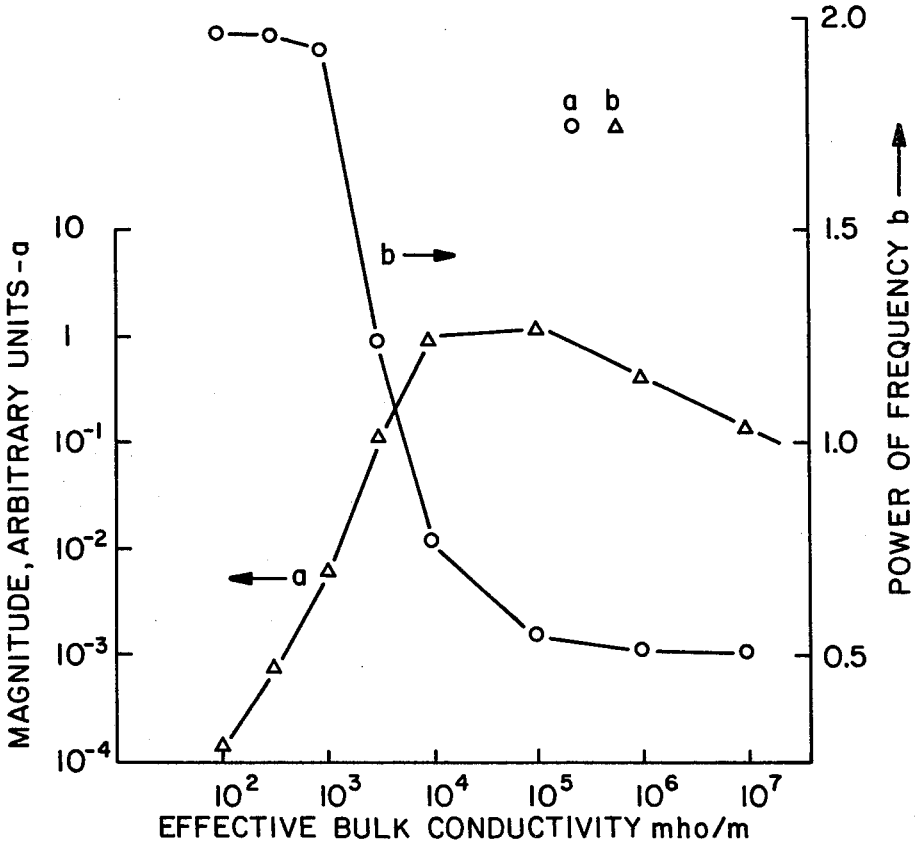
FIG. 10 THEORETICAL POWER OF FREQUENCY LAW COEFFICIENTS FOR EDDY CURRENT LOSSES

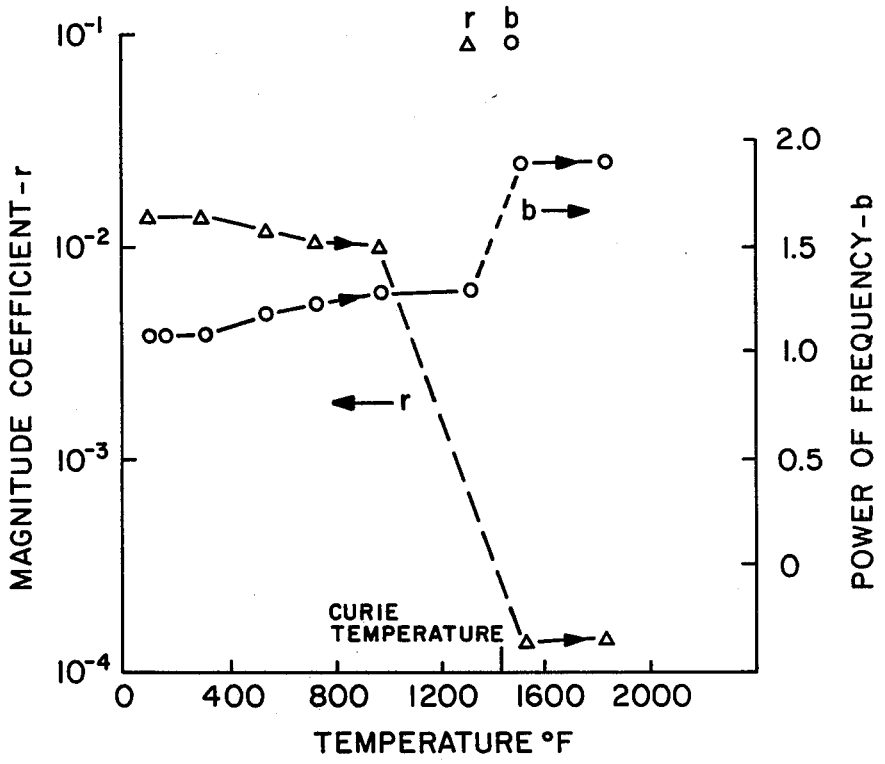
FIG.11 MEASURED POWER OF FREQUENCY LAW COEFFICIENTS FOR COIL RESISTANCE VERSUS TEMPERATURE - RUN 1
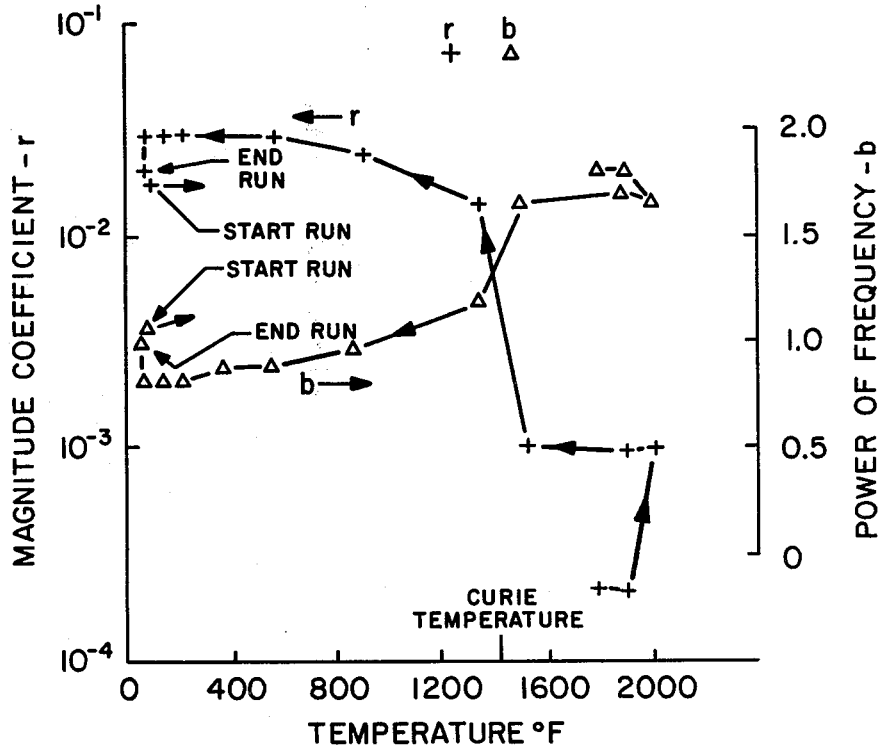
FIG.12 MEASURED POWER OF FREQUENCY LAW COEFFICIENTS FOR COIL RESISTANCE VERSUS TEMPERATURE - RUN 2

METHOD OF MONITORING CONVERSION OF IRON ORE INTO HIGH CONTENT PELLETS

BACKGROUND OF THE INVENTION

1. Field of the Invention

This invention is directed to apparatus and method of monitoring iron ore conversion.

2. Description of the Prior Art

In the conversion of iron ore into high grade iron pellets, the practice heretofore has been to place a batch of the ore into a converter and then heated and cooling reduction gases are passed through the ore in certain sequence and at determined temperatures and predetermined time periods. The problem with this type of method is that it requires the ore to be of tested sample and must have a very accurate regulation of the sequences. Even with great precautions the resulting product would not be exactly uniform. Furthermore, if the reduced ore was dumped at over 150° F., it might burn up as a result of an exothermic reaction.

SUMMARY OF THE INVENTION

This invention is directed to a novel method and apparatus for monitoring the changes taking place in materials in specific zones in a converter such that the conversion may be terminated when the ore is fully processed and the product cooled to a stable temperature prior to dumping from the reactor.

The invention contemplates using a series of coils spaced along the length of the converter and through inductance measuring the iron content of each sample and also the temperature of sample inside the converter. Such control could possibly reduce the normal 6 hour cycle to about 4 hours for conversion.

The invention comprehends a novel apparatus for locating hot spots in batches of material which could lead to an exothermic reaction when dumped into receiving bins.

A further object is to provide a temperature gauge for temperatures up to the Curie point to provide better control of the temperature of the particles and thus prevent fusing.

These and other objects and advantages inherent in and encompassed in the invention will become more readily apparent from the specification and the drawings.

BRIEF DESCRIPTION OF THE DRAWINGS

FIG. 6 is a schematic diagram of the monitoring circuit.

FIG. 7 is a graph of the Measured Coil Resistance versus frequency for Reduced Pellets;

FIG. 8 is a graph of the Measured Coil Resistance versus Temperature for Reduced Pellets—Run 1;

FIG. 9 is a graph of the Measured Coil Resistance versus Temperature for Reduced Pellets—Run 2;

FIG. 10 is a graph of the Effective Bulk Conductivity mho/m of the Pellets;

FIG. 11 is a graph of the Measured Power of Frequency Coefficients for Coil Resistance versus Temperature—Run 1;

FIG. 12 is the same as FIG. 11 but of Run 2.

DESCRIPTION OF THE PREFERRED EMBODIMENT

Figure 1:
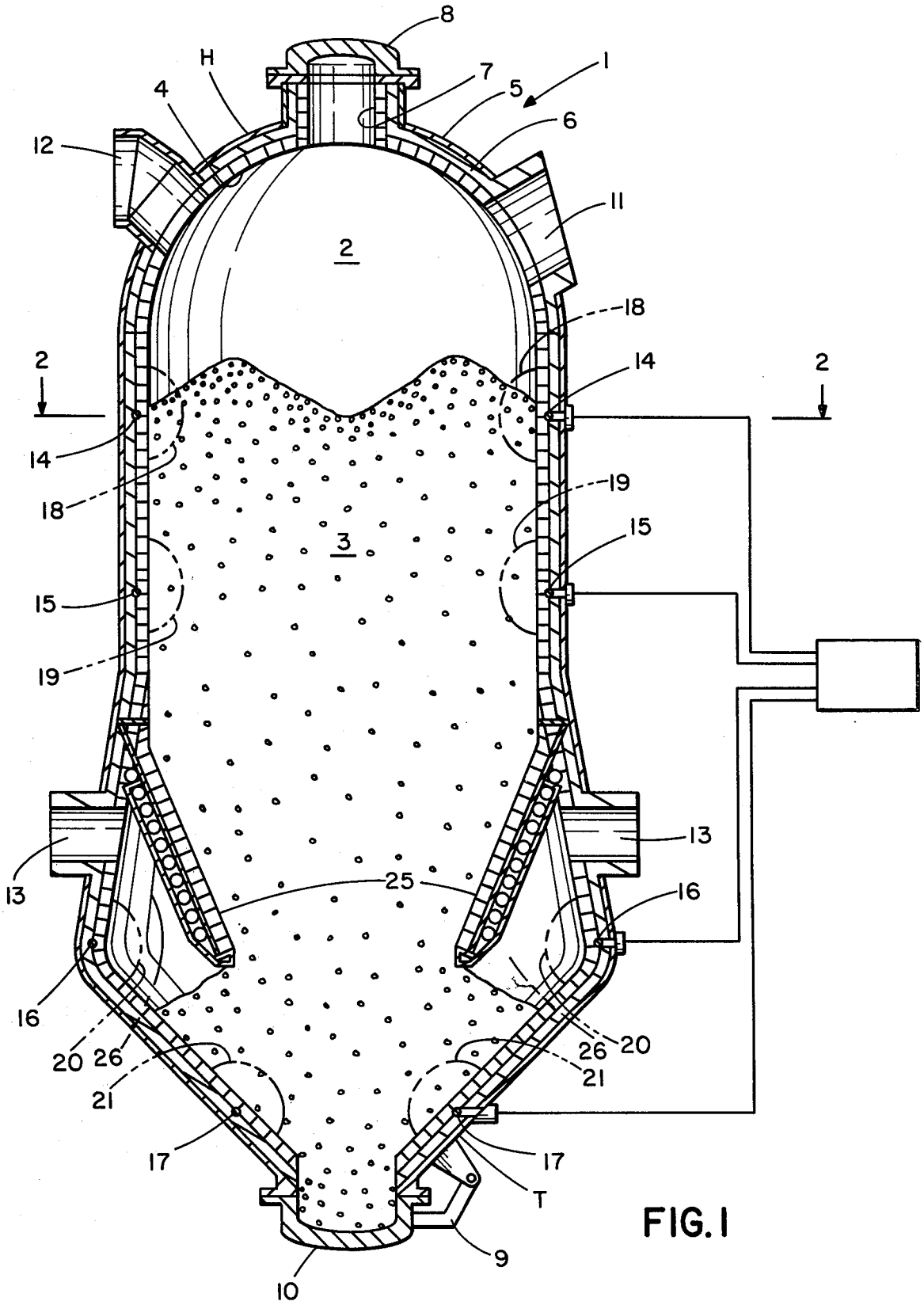
FIG. 1 is a vertical cross-section of a reactor including the monitoring system.
Figure 2:
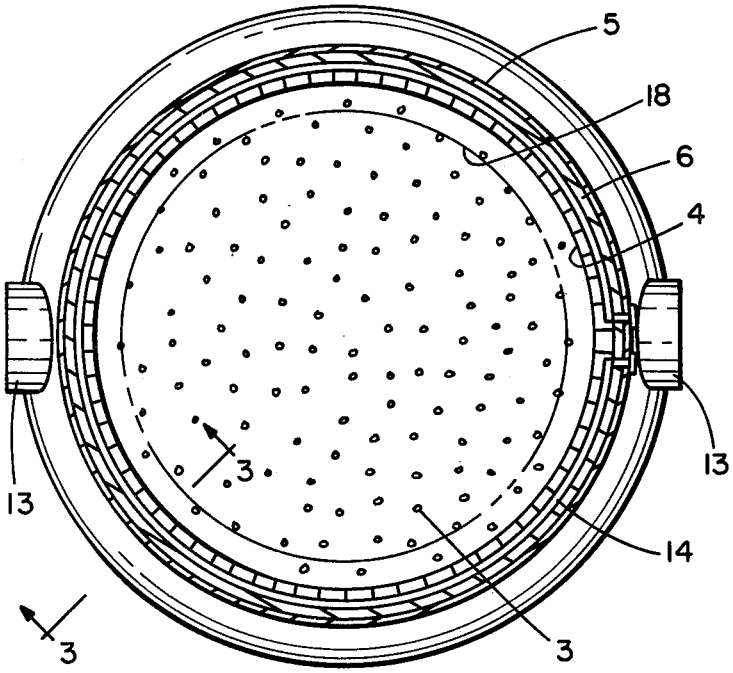
FIG. 2 is a cross-section taken essentially on line 2—2 of FIG. 1.
Figure 3:
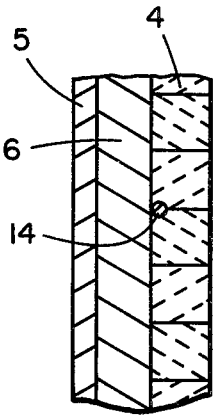
FIG. 3 is an enlarged fragmentary cross-section taken substantially on line 3—3 of FIG. 2.

As shown in FIGS. 1–3, the temperature and metallization monitoring system embodied in the present invention is particularly suited for fixed bed reactors used in the production of sponge iron from iron ore. The sponge iron reactor 1 shown in the drawings includes a chamber 2 in which iron ore 3 is reduced to sponge iron. The chamber 2 is defined by a generally cylindrical wall lined with refractory brick 4 at its inner surface and a steel casing or shell 5 at its outer surface. Interposed between the refractory brick lining 4 and the steel casing 5 is a layer of cast refractory material 6, which, with the brick lining, serves to shield the steel casing from the internal heat of the reactor.

As can be seen from the drawings, the reactor is generally similar to that disclosed in U.S. Pat. No. 3,467,368. The upper end of the reactor 1 terminates in a hemisphere H and the lower end in a truncated conical section T. The chamber 2 is charged with iron ore 3 by means of the charging inlet 7 located at the top of the reactor. The inlet is provided with a door 8 which is opened during charging of the reactor and closed to form a tight seal during reduction of the iron ore as is well known. At the bottom of the reactor 1, a discharge outlet 9 is provided which has a door 10 which can be opened to discharge the reactor and closed to form a tight seal prior to recharging the iron ore.

As is well known in the art, hot reducing and cooling gases are supplied through gas inlets 11 and 12, respectively, located near the top of the chamber 2. During reduction process, the gases pass downward through the ore and leave the reactor through the gas outlets 13 located at the lower end of the chamber 2.

As shown in FIGS. 1–3, the monitoring system provides for a series of vertically spaced sensing wires or coils 14, 15, 16 and 17 embedded in the reactor wall between the refractory brick 4 and the refractory material 6. The wires or coils 14, 15, 16 and 17 are vertically spaced so as to detect the temperature and the degree of metallization of the ore in the four vertically spaced zones 18, 19, 20 and 21 schematically shown in phantom lines in FIGS. 1 and 2 during the reduction process as hereinafter described. Thus, both the degree of metallization and the temperature of the ore can be monitored throughout the reduction process.

Figure 4:
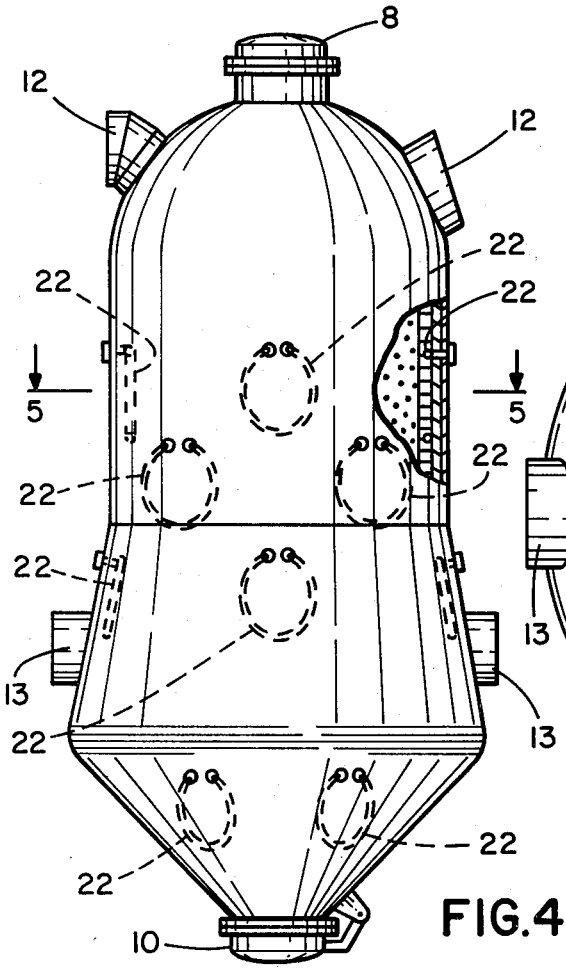
FIG. 4 is a side elevational view of another embodiment of the reactor with portions broken away and shown in section.
Figure 5:
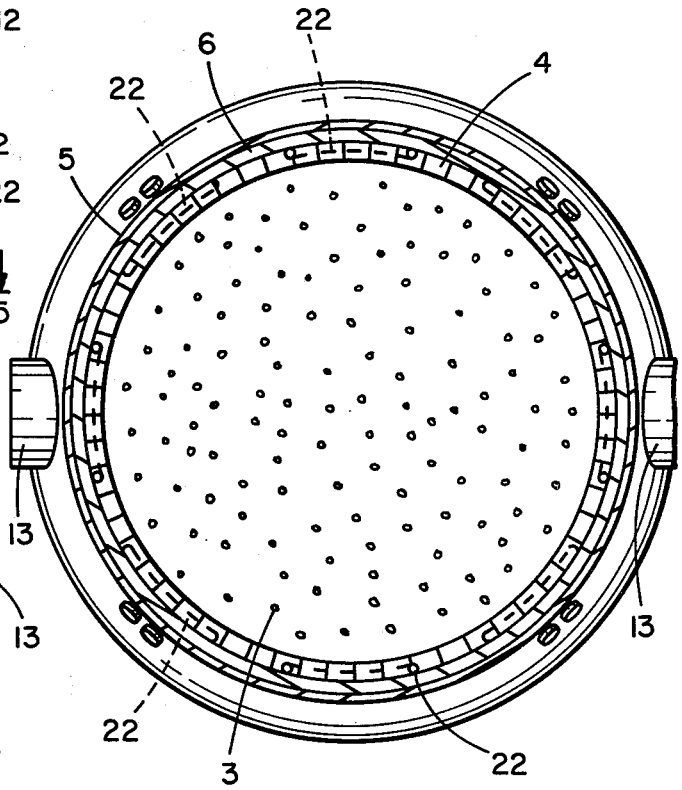
FIG. 5 is an enlarged cross-section taken substantially on line 5—5 of FIG. 4.

FIGS. 4 and 5 show an alternative embodiment of the invention which is particularly suited to obtain localized measurements of metallization and temperature about the circumference of the chamber 2 within each vertical zone as well as vertically within the chamber. Specifically, a series of eight coils 22 are embedded as the coils 14, 15, 16 and 17 in the wall spaced about its periphery, thus providing eight distinct measurements of the ore properties for each of the vertically spaced sensing zones within the reactor. It should be noted that the coils 22 of the adjacent zones are vertically staggered so as to optimumly monitor the properties of the greatest amount of ore.

There is also provided a funnel or conical shaped shield 25 at the lower end of the converter about the outlet 9 and provides a chamber 26 at zone 20 for accommodating the calibration coil 16 in radially outwardly spaced relation to the ore to provide a reference for the other monitoring coils.

Monitoring Circuitry

As noted above, experimental results and testing have established that the degree of metallization, and fusion and discharge temperatures of the ore during the reduction process can be monitored by an electrical system such as shown schematically in FIG. 6.

The proposed operational measurement system consists of one or more conducting coils 14–17 embedded in the refractory lining of the reactor and encircling the cylindrical ore-filled region. The ore medium thus forms the core of the induction coil and the impedance at the terminals of the coil is influenced by the electromagnetic properties of this core material.

Two electromagnetic properties of the ore medium influence the terminal behavior of the coil; namely, the magnetic permeability and the electrical conductivity. In principle both of these properties can be determined from electrical measurements at the terminals of the coil. In practice, however, several unknown factors require evaluation before the relationship between these physical properties of the ore and the electrical measurements at the coil terminals can be predicted. Of perhaps the greatest importance is the fact that the ore medium is not a uniform homogeneous material but, instead, is a random medium consisting of particles of varying size and shape. The effective bulk permeability and conductivity of this random medium are significantly different from these properties of the reduced ore pellet material itself. Another significant influence on the behavior of the system is the temperature dependence of the electromagnetic properties of iron. In particular, the relative magnetic permeability of iron changes significantly with temperature and essentially vanishes above the Curie temperature of 770° C. (1418° F.). Since the reduction process is completed at about 2000° F. (1093° C.), well above the Curie temperature, only the electrical conductivity remains as an influence on the coil during the process in the upper temperature region.

In evaluating this technique both technical and experimental studies have been conducted. Because of unknown factors, both approaches to the problem have proved to be essential. Initial theoretical analysis aided in the design by predicting the most promising frequency range for the measurements.

The basic problem, as heretofore described, is to determine the relationship between certain electrical measurements at the terminals of a coil and the physical properties of the material medium about which the coil is wound. The actual system consists of cylindrical solenoidal coils as shown in FIG. 1. From measurements made at the terminals of this coil, the physical properties of the pellet material are monitored during their reduction to essentially metallic sponge iron. Insofar as the measurement system is concerned, the coil simply represents a lumped-constant electrical circuit characterized by its terminal impedance. The relation of this terminal impedance to the properties of the iron pellet core medium and the geometry of the coil is an electromagnetic field theory problem. Since the electrical conductivity of the reduced pellets is high, only relatively low frequency electromagnetic fields will penetrate the bulk volume of the material and hence be capable of monitoring the properties of the pellet medium throughout the reactor. At these low frequencies the dielectric properties of the medium play no important role in determining the coil impedance. Therefore the monitor arrangement must be analyzed as a quasi-static magnetic field system.

The power loss associated with the conductor from which the coil is constructed is essentially the conventional $I^2R$ loss of a simple resistance. The situation becomes somewhat more complicated, however, since the measurement frequencies used, especially in experimental models, are high enough for skin effects in the conductor to become significant. This skin effect causes the current density within the conductor to be concentrated near the wire surface and thus modifies the resistance per unit length of the conductor. In addition, the impedance per unit length of the conductor must be considered rather than purely resistive, adding to the inductance of the coil.

Since water cooling of the coil is considered to be potentially necessary, copper tubing is preferred for construction of the coil.

The reduced pellets are dominantly metallic iron and hence are ferromagnetic below the Curie temperature. The magnetic permeability and hysteresis effect will therefore contribute significantly to the measured coil impedance at reactor processing conditions below the Curie temperature. Above the Curie temperature the magnetic permeability essentially vanishes and therefore need not be considered. However, since it will be desirable to conduct some measurements during the heating or cooling of the reactor, hysteresis losses in the pellet medium must be analyzed.

The only contribution by the pellet medium to the resistance of the coil at temperature above the Curie point is due to eddy currents induced in the medium by the time varying magnetic field. The behavior of these currents and the resulting coil resistance must be analyzed in some detail.

The pellet-filled region actually is best represented as a random medium. However, from studies of random media it is known that effective bulk values of the constitutive parameters in such randomly composite media may, in many cases, be used to describe the electromagnetic behavior in terms of a uniform homogeneous medium. Thus, one of the objectives of the eddy current analysis is to obtain relationships which together with experimental data, provide a measure of effective bulk conductivity.

When a series circuit consisting of an inductor, a capacitor, and resistance is excited by an impulse, a damped oscillation will occur. The frequency of oscillation is a function of the values of the inductor and capacitor; the amplitude decay versus time is a function of the total resistance in the series circuit.

The circuit diagram comprises a power supply shown in box PS; a pulse generator shown in box PG; the signal input SI; and the measuring circuit MC.

The circuit diagram of the measurement circuit is shown in FIG. 6. Each cycle of operation begins with the transistor switch Q1 turned off so that capacitor C1 could charge through resistance R1 and the measurement coil L1. When Q1 was turned on by a positive pulse from the pulse generator, the voltage across C1 caused a current to flow through Q1, C1, and L1. The current oscillated at a frequency determined by C1 and L1, and was damped by the total series resistance. Capacitor C1 was selected to determine the oscillation frequency.

A measurement of the average voltage of the waveform was provided by the detector circuit through CR1 and the digital voltmeter.

The reference voltmeter reading was made with R1 set at zero from reference coil 16. When the pellet (ore) sample is placed in the sample coil L1, the loss resistances related to eddy current loss and hysteresis loss were reflected as an increase in effective series resistance in the coil (due to structure, skins, and sample). The resulting voltmeter reading was recorded. R1 was then set to reproduce the voltmeter reading which was recorded with the pellet sample in the coil. The setting of R1 was then recorded as the value of series resistance which was reflected into the coil from the ore sample.

The most accurate and experimentally significant of the several series of measurements performed were the two final runs made in a tube furnace. The results of these two runs are presented and discussed in detail below. The measured data from these two runs are presented in Tables I and II.

At each temperature the coil was tuned by a fixed capacitor for a resonant frequency near 50, 100, or 200 kHz with air as the core material. From the data in Tables I and II this resonant frequency is noted to decrease when the reduced pellet sample was inserted within the coil for all temperatures below the Curie temperature (1418° F.). This decrease in resonant frequency indicates an increase in inductance of the coil caused by the increase in magnetic permeability of the reduced pellets. Above the Curie temperature, however, the resonant frequency is seen to remain the same as that obtained with the air core coil, corresponding with the expected loss of magnetic properties of the pellets above the Curie point.

The measured equivalent resistances from Run 1 are shown in FIG. 7 as functions of frequency for three different temperatures. As expected, the resistance, i.e., composite power loss in the pellets, increases with frequency at all temperatures. However the magnitude of the resistance and the behavior as a function of frequency is significantly different above and below the Curie temperature.

TABLE I

MEASURED COIL RESISTANCE AND RESONANT FREQUENCY FOR REDUCED IRON ORE PELLETS
Run 1

| Temperature | Resonant Frequency kHz | | Equivalent Resistance | $rf^b$ Coefficients | |
|---|---|---|---|---|---|
| deg. F | Air | Pellets | ohms | r | b |
| 83 | 51.5 | 47.8 | 1.62 | | |
| 83 | 91 | 87.0 | 3.17 | | |
| 83 | 200 | 193 | 7.50 | 0.02 | 1.1 |
| 157 | 51.5 | 46.5 | 1.58 | | |
| 167 | 91 | 87.0 | 3.143 | | |
| 172 | 200 | 193 | 7.65 | 0.02 | 1.1 |
| 294 | 51.5 | 46.5 | 1.527 | | |
| 294 | 91 | 87.0 | 3.114 | | |
| 296 | 200 | 193 | 7.65 | 0.02 | 1.1 |
| 563 | 51.5 | 46.5 | 1.418 | | |
| 556 | 91 | 87.0 | 3.115 | | |
| 548 | 200 | 193 | 7.95 | 0.0014 | 1.2 |
| 738 | 51.5 | 56.5 | 1.389 | | |
| 730 | 91 | 83 | 3.143 | | |
| 722 | 200 | 193 | 8.35 | 0.012 | 1.25 |
| 1009 | 51.5 | 45.5 | 1.547 | | |
| 995 | 91 | 83 | 3.620 | | |
| 981 | 200 | 190 | 9.95 | 0.011 | 1.3 |
| 1321 | 51.5 | 44.5 | 1.665 | | |

TABLE I-continued

MEASURED COIL RESISTANCE AND RESONANT FREQUENCY FOR REDUCED IRON ORE PELLETS
Run 1

| Temperature | Resonant Frequency kHz | | Equivalent Resistance | $rf^b$ Coefficients | |
|---|---|---|---|---|---|
| deg. F | Air | Pellets | ohms | r | b |
| 1308 | 91 | 80 | 3.950 | | |
| 1319 | 200 | 188 | 11.00 | 0.012 | 1.3 |
| 1527 | 51.5 | 51.5 | .395 | | |
| 1517 | 91 | 91 | 1.274 | | |
| 1521 | 200 | 200 | 5.350 | $2 \times 10^{-4}$ | 1.9 |
| 1838 | 51.5 | 51.5 | .420 | | |
| 1839 | 91 | 91 | 1.328 | | |
| 1834 | 200 | 200 | 5.70 | $2.2 \times 10^{-4}$ | 1.9 |
| 83 | 51.5 | 47.8 | 2.550 | | |
| 83 | 91.0 | 91.0 | 4.275 | | |
| 83 | 200 | 209 | 8.55 | 0.106 | 0.82 |

TABLE II

MEASURED COIL RESISTANCE AND RESONANT FREQUENCY FOR REDUCED IRON ORE PELLETS
Run 2

| Temperature | Resonant Frequency kHz | | Equivalent Resistance | $rf^b$ Coefficients | |
|---|---|---|---|---|---|
| deg. F | Air | Pellets | ohms | r | b |
| Increasing Temperature | | | | | |
| 79 | 51.5 | 47.5 | 1.686 | | |
| 79 | 91 | 87.0 | 3.217 | | |
| 79 | 200 | 198 | 7.55 | 0.03 | 1.05 |
| 1797 | 51.5 | 51.5 | 0.513 | | |
| 1795 | 91 | 91 | 1.594 | | |
| 1801 | 200 | 206 | 6.23 | $4.6 \times 10^{-4}$ | 1.8 |
| 1901 | 51.5 | 51.5 | 0.544 | | |
| 1901 | 91 | 91 | 1.673 | | |
| 1901 | 200 | 204 | 1.50 | $4.8 \times 10^{-4}$ | 1.8 |
| 2005 | 51.5 | 51.5 | 0.666 | | |
| 2000 | 91 | 91 | 1.962 | | |
| 2002 | 200 | 206 | 6.75 | $1 \times 10^{-3}$ | 1.66 |
| Decreasing Temperature | | | | | |
| 1901 | 51.5 | 51.5 | .663 | | |
| 1906 | 91 | 93 | 1.967 | | |
| 1901 | 200 | 206 | 6.75 | $9.6 \times 10^{-4}$ | 1.7 |
| 1519 | 51.5 | 51.5 | .666 | | |
| 1520 | 91 | 91 | 1.967 | | |
| 1504 | 200 | 206 | 6.67 | $1.0 \times 10^{-3}$ | 1.65 |
| 1357 | 51.5 | 46.5 | 1.869 | | |
| 1355 | 91 | 83 | 4.150 | | |
| 1355 | 200 | 190 | 10.0 | 0.02 | 1.2 |
| 898 | 51.5 | 46.5 | 2.563 | | |
| 887 | 91 | 83 | 4.650 | | |
| 869 | 200 | 192 | 10.20 | 0.06 | 0.97 |
| 561 | 51.5 | 47.5 | 2.750 | | |
| 551 | 91.0 | 86.1 | 4.575 | | |
| 549 | 200 | 196 | 9.55 | 0.09 | 0.88 |
| 385 | 51.5 | 48.5 | 2.600 | | |
| 381 | 91.0 | 87.0 | 4.400 | | |
| 378 | 200 | 200 | 9.000 | 0.09 | 0.88 |
| 200 | 51.5 | 48.8 | 2.500 | | |
| 203 | 91.0 | 91.0 | 4.100 | | |
| 205 | 196 | 202 | 8.250 | 0.09 | 0.84 |
| 152 | 51.5 | 50.0 | 2.456 | | |
| 152 | 91.0 | 90.1 | | | |
| 153 | 200 | 204 | 8.00 | 0.09 | 0.84 |
| Room Temperature - Next Morning | | | | | |
| 80 | 51.5 | 50.0 | 2.367 | | |
| 80 | 91.0 | 91.0 | 3.860 | | |
| 80 | 200 | 204 | 7.55 | 0.09 | 0.82 |
| Pellets Broken Loose | | | | | |
| 73.7 | 51.5 | 47.5 | 1.927 | | |
| 73.7 | 91.0 | 86.1 | 3.520 | | |
| 73.7 | 200 | 192 | 7.85 | 0.04 | 1.0 |

The values for measured reflected resistance as a function of temperature are shown in FIG. 8 and 9. Again the resistance is seen to change with temperature at all frequencies. The transition at the Curie temperature is particularly apparent in these curves. The two runs differ in the direction of change of temperature during the measurements. All measurements in Run 1 were taken during heating of the pellet samples. Most of the measurements taken during Run 2 were taken during cooling of the pellets, as shown in FIG. 9.

It was considered impractical to actually perform reduction of the pellet material and no data are presented for the unreduced pellets. All initial measurements using unreduced pellets shown no change in coil resistance or resonant frequency from those observed with the air core coil. These results indicated that both the magnetic permeability and the conductivity of the unreduced pellets are very low.

Comparison of the experimental data and the theoretical predictions of the input impedance of the coil reveal some significant features of the measured results. The most easily distinguishable feature of the two major loss mechanisms, i.e., hysteresis effect and induced eddy currents, is the frequency dependence. The hysteresis losses vary essentially as the first power of frequency. On the other hand, the eddy current losses vary as the second power of frequency.

For comparison of the measured and theoretical results it is convenient to express the behavior vs. frequency approximately by the simple power law $$\frac{P_L}{B_o^2} = a f_{kHz}^b$$

The eddy current losses are predictable. The computed values of the coefficients a and b are shown as a function of the effective conductivity in FIG. 10.

Examination of the curves shown in FIG. 10 reveals several important features of the eddy current loss mechanism. The most striking feature seen is the rapid transition from a $f^2$ behavior to a $\sqrt{f}$ behavior as the conductivity increases from about $10^3$ mho/meter to $10^4$ mho/meter. Within the $f^2$ region the magnetic field is distributed uniformly throughout the pellet region. Within the $\sqrt{f}$ region, however, skin effects prevail and the interior of the pellet region is shielded by currents excited on the periphery. For the monitoring of conditions throughout the retort the system must therefore operate within or near the $f^2$ region. Advantage can be taken, however, of the rapid change which occurs within the region of transition, and operation within this region will increase the sensitivity of the system to changes in the effective bulk conductivity of the pellet medium. The curves plotted in FIG. 10 were computed specifically for an experimental system. Where a is the radius of the cylindrical pellet-filled region for any given size reactor, it will be possible to choose a frequency range which will place the system in the most desirable operating region of the curves.

The measured data expressed in terms of a power of frequency law is shown in FIGS. 11 and 12. The magnitude coefficient designated as r in these figures differs in units from the a coefficient in FIG. 10 and therefore may not be quantitatively compared to the magnitude coefficient curve of FIG. 10. The power of frequency coefficient b has the same meaning as that shown in FIG. 10 and therefore may be directly compared. The coefficients are plotted as functions of temperature in FIGS. 11 and 12, in contrast to FIG. 10 which is plotted as a function of effective bulk conductivity.

The eddy current losses alone can be evaluated by first examining the data taken above the Curie temperature ($T_c$). For Run 1 and except for the 2000° F. (1093° C.) temperature in Run 2, the resistance measured above $T_c$ during heating show a dependence corresponding to a 1.8 to 1.9 power of frequency. Comparison of this value with the theoretical values shown in FIG. 9 indicates an effective conductivity in the range of $10^3$ to $5\times10^3$ mho/meter.

The data taken below $T_c$, as shown in FIG. 11, exhibit a 1 to 1.3 power of frequency variation. This frequency dependence together with the higher magnitude of resistance (a coefficient) indicates that below $T_c$, eddy currents play only a minor role while the major loss mechanism is that of hysteresis.

The data recorded in Run 2 shows another effect which may be of importance. During this run one data point was recorded at room temperature; the pellets were then heated to about 1800° F. (982° C.), a measurement was made at that temperature and also at 1900° F. (1038° C.) and 2000° F. (1093° C.) during the heating cycle; all other data were recorded during cooling. Examination of FIG. 12 shows that a significant change occurred between 1900° F. (1038° C.) and 2000° F. (1093° C.) during heating. Within this temperature change the magnitude coefficient increase by a factor of about two and the frequency dependence decreased from a 1.8 power law to a 1.66 power law. From the computed data in FIG. 10 it is seen that both of these changes are consistent with an increase in effective conductivity of the medium. This increased resistance and reduced power of frequency behavior were maintained throughout the cooling cycle. After the sample had cooled it was discovered that a portion of the pellets had in fact fused at points of contact. A final measurement conducted after the pellets were broken apart yielded results close to those measured at room temperature before heating the sample. It is apparent from this analysis that this fusion of the pellets occurred between 1900° F. (1038° C.) and 2000° F. (1093° C.), and resulted in a significant increase in the effective bulk conductivity of the pellet sample.

From the theoretical and experimental investigations discussed above, the magnetic induction technique is shown to be a useful means for monitoring the electrical properties and related metallization of iron ore pellets during reduction by the HyL process. The measured data clearly show features such as hysteresis loss, loss transitions at the Curie temperature, and eddy current losses above the Curie point. In the data measured during Run 2 of the experimental tests, the increased effective conductivity which resulted from fusion of the metallized pellets is also clearly shown. The usefulness of the technique for monitoring temperature of the pellet charge within a reactor depends on changes in electrical properties of pellet charges in relation to temperature changes. There appear to be practicable frequencies at which changes in effective series resistance are of such magnitude at high and low temperature ends of reduction runs that temperature levels can be interpreted from them. As shown in FIG. 8, the slopes of curves plotting equivalent series resistance vs. temperature indicate that changes in resistance in the uppermost region of heating, i.e., around 1800° to 2000° F. (982° to 1093° C.), were of sufficient magnitude to be of use in establishing resistance/temperature relationships, especially at a frequency of 200 kHz and possibly also at 91 kHz. The same plots show that establishment of similar relationships appear possible during cooldown, particularly in the region of 150° to 200° F. (66° to 93° C.) which is of particular interest with respect to discharge of pellets. It is preferred that samples be taken of many runs to obtain repeatable and reliable means of temperature determination from one reduction to run to another, using pellets made from the same iron ore. It seems likely that temperature/resistance relationships would have to be determined anew for each different iron ore used in making metallized pellets.

The theoretical analysis of the eddy current losses has provided an effective means for relating the measured coil resistance to the effective bulk conductivity of the pellet region. Analysis of the experimental data in conjunction with the behavior predicted from the theoretical analysis has proved that the induction technique is a sensitive means for monitoring the effective bulk conductivity of the pellet medium. Since this effective bulk conductivity is indirectly related to the degree of metallization, the progress of the reduction process can be monitored by this technique. In addition to the ability to monitor the metallization process, the large change in effective bulk conductivity which was observed as a result of fusion of the pellets may be of interest. This phenomena should provide a method of detecting the fusion process at an early enough stage for corrective action to be taken.

The effective series resistance measurement system is shown to be a simple and rapid means for obtaining the necessary data.

What is claimed is:

1. A method of reducing ore having a certain percentage of iron into a product having a higher usable percentage of iron comprising:

loading a batch of ore into a converter, subjecting the ore in the converter to a reducing medium, and concurrently monitoring increases in iron content in the ore by measuring change in the inductance of a measuring coil which is located in the vicinity of a preselected portion of the ore.

2. The invention according to claim 1, wherein said measuring is conducted at several predetermined locations in the batch.

3. The invention according to claim 2, and removing the remaining processed ore after the ore has reached a selected iron percentage.

4. The invention according to claim 1, and regulating the reducing medium to obtain product and maintain the same within certain parameters.

5. The method of claim 1, wherein said inductance changes are employed to determine when the reduction process is operating above the Curie point of the ore.

6. The method of monitoring the metallization of iron ore pellets during a reduction process which comprises the steps of:

supplying pulses of current to an induction coil which is coupled to said iron ore pellets as they are being reduced, and measuring variations in the effective resistance of said induction coil due to reduction process changes in said iron ore pellets.

7. The method of claim 6, wherein said reduction process is carried on at an elevated temperature and said variation in effective resistance is employed to detect the fusing together of said iron ore pellets.

8. The method of claim 6, which includes the steps of measuring the average voltage developed across the induction coil during the reduction process, and comparing said measured average voltage to the average voltage developed across an induction coil when surrounded by air.

9. The method of reducing ore having a certain percentage of iron into a product having a higher usable percentage of iron comprising:

loading a batch of ore into a converter, subjecting the ore in the converter to a reducing medium, and concurrently monitoring changes in the reduction process by measuring variations in the effective resistance of an induction coil which is coupled to the ore in said converter and is energized by periodically recurring electrical pulses.

10. The method of claim 9, wherein said monitoring is conducted at several predetermined locations in the batch.

11. The method of claim 9, wherein said resistance variations are employed to determine the temperature at which said reduction process is being carried out.

12. The method of claim 9, wherein said resistance variations are employed to determine the temperature of the ore in the vicinity of said induction coil.

13. The method of claim 12, wherein the unreduced ore is in the form of pellets and said resistance variations are measured in a temperature range of from 1800° F. to 2000° F. to detect fusion of the pellets during the reduction process.

14. The method of claim 9, which includes the step of resonating said induction coil so that said electrical pulses develop damped oscillations in said coil.

15. The method of claim 14, which includes the step of varying the frequency of said damped oscillations.

16. The method of claim 15, wherein the frequency of said damped oscillations is chosen so that said resistance measurements are made in the region wherein eddy current losses in the ore vary as the square of the frequency.

17. The method of claim 15, wherein the frequency of said damped oscillations is chosen so that said resistance measurements are made in the region wherein eddy current losses within the ore undergo a transition from varying in proportion to the square of the frequency to varying in proportion to the square root of the frequency.

18. The method of claim 14, wherein said resistance measurements are made by measuring variations in the rate of decay of said damped oscillations.

19. The method of claim 9, wherein said resistance variations are employed during cooling of the ore after it has been reduced to determine when the reduced ore may be safely discharged from the converter.

20. The method of claim 19, wherein said resistance measurements are made in a temperature range of from 100° F. to 200° F.

* * * * *